US006379185B2

(12) United States Patent
Belopolsky et al.

(10) Patent No.: US 6,379,185 B2
(45) **Date of Patent: *Apr. 30, 2002**

(54) SHIELD FOR MODULAR JACK

(75) Inventors: Yakov Belopolsky, Harrisburg; Peter D. Curwen, York Haven, both of PA (US)

(73) Assignee: FCI Americas Technology, Inc., Reno, NV (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/382,098

(22) Filed: Aug. 24, 1999

Related U.S. Application Data

(60) Continuation of application No. 08/936,105, filed on Sep. 23, 1997, now Pat. No. 5,957,726, which is a division of application No. 08/690,548, filed on Jul. 31, 1996, now Pat. No. 5,788,538.

(51) Int. Cl.[7] ..... H01R 13/648
(52) U.S. Cl. ..... 439/607; 439/939
(58) Field of Search ..... 439/607, 939, 439/609

(56) References Cited

U.S. PATENT DOCUMENTS

| | | | | |
|---|---|---|---|---|
| 4,386,814 | A | 6/1983 | Asick | 339/14 R |
| 4,655,532 | A | 4/1987 | Hillis et al. | 339/143 R |
| 4,820,885 | A | 4/1989 | Lindsay | 174/35 GC |
| 4,838,811 | A | 6/1989 | Nakamura et al. | 439/607 |
| 4,878,858 | A | 11/1989 | Dechelette | 439/607 |
| 4,889,958 | A | 12/1989 | Takahashi et al. | 174/35 MS |
| 4,936,795 | A | 6/1990 | Kawai et al. | 439/609 |
| 4,938,714 | A | 7/1990 | Kawai et al. | 439/607 |
| 4,943,244 | A | 7/1990 | Teck et al. | 439/567 |
| 4,966,637 | A | 10/1990 | Laborie | 156/47 |
| 4,980,516 | A | 12/1990 | Nakagawa | 174/35 GC |
| 4,983,127 | A | 1/1991 | Kawai et al. | 439/79 |
| 4,993,971 | A | 2/1991 | Matsuzaki et al. | 439/607 |
| 5,022,871 | A | 6/1991 | Sekiguchi | 439/609 |
| 5,072,070 | A | 12/1991 | Balsells | 174/35 GC |
| 5,083,945 | A | 1/1992 | Miskin et al. | 439/607 |
| 5,091,606 | A | 2/1992 | Balsells | 174/35 GC |
| 5,147,121 | A | 9/1992 | McIlwraith | 312/296 |
| 5,162,980 | A | 11/1992 | Morgan et al. | 361/424 |

(List continued on next page.)

FOREIGN PATENT DOCUMENTS

| | | | |
|---|---|---|---|
| EP | 0 430 105 A1 | 5/1991 | |
| FR | 627791 A1 | 12/1994 | 23/68 |

OTHER PUBLICATIONS

IBM Technical Disclosure Bulletin, vol. 39 No. 02 Feb. 1996 Entitled: Electro–Magnetic Interference–Clip High Speed Interconnect.

*Primary Examiner*—P. Austin Bradley
*Assistant Examiner*—Edwin A. León
(74) *Attorney, Agent, or Firm*—M. Richard Page; Steven M. Reiss

(57) ABSTRACT

Disclosed is a metallic shield for a modular jack which includes a first member which is superimposed over the top and lateral wall of the jack. A second member surrounds the front plug openings. A first tab on the second member engages an aperture on the first member. A second tab on the second member curves rearwardly and upwardly then rearwardly and downwardly to abut the first member. A third tab on the second member curves rearwardly and upwardly to engage a panel.

29 Claims, 4 Drawing Sheets

U.S. PATENT DOCUMENTS

| | | | | |
|---|---|---|---|---|
| 5,178,562 | A | | 1/1993 | Ermini ..... 439/609 |
| 5,195,911 | A | | 3/1993 | Murphy ..... 439/607 |
| 5,204,496 | A | | 4/1993 | Boulay et al. ..... 174/35 GC |
| 5,207,597 | A | | 5/1993 | Kline et al. ..... 439/607 |
| 5,228,872 | A | | 7/1993 | Liu ..... 439/607 |
| 5,288,248 | A | | 2/1994 | Chen ..... 439/609 |
| 5,348,484 | A | | 9/1994 | Sorrentino ..... 439/101 |
| 5,364,574 | A | | 11/1994 | Panayappan et al. ..... 264/46.6 |
| 5,378,172 | A | | 1/1995 | Roberts ..... 439/607 |
| 5,383,098 | A | | 1/1995 | Margate et al. ..... 361/818 |
| 5,397,250 | A | | 3/1995 | Briones ..... 439/620 |
| 5,418,023 | A | | 5/1995 | Hernandez et al. ..... 428/36.5 |
| 5,496,195 | A | | 3/1996 | Reed |
| 5,511,992 | A | | 4/1996 | Thalhammer ..... 439/609 |
| 5,788,538 | A | * | 8/1998 | Belopolsky et al. ..... 439/607 |
| 5,957,726 | A | * | 9/1999 | Belopolsky et al. ..... 439/607 |

* cited by examiner

SHIELD FOR MODULAR JACK

CROSS-REFERENCE TO RELATED APPLICATIONS

This application is a continuation of U.S. patent application Ser. No. 08/936,105, filed on Sept. 23, 1997 and now U.S. Pat. No. 5,957,726, which is a divisional of U.S. patent application Ser. No. 08/690,548, filed on Jul. 31, 1996 and now U.S. Pat. No. 5,788,538.

BACKGROUND OF THE INVENTION

1. Field of the Invention

The present invention relates to electrical connectors and more particularly to modular jacks.

2. Brief Description of Prior Developments

Modular jacks are well known for telecommunications and computer networking purposes. These jacks usually include a rectangular opening with at least one upper keyway. A plug having a rectangular cross section and lower surface contacts and an upper key lock is inserted into the jack. Upon such insertion, the upper key lock snaps into a locking position with the upper keyway of the jack, and the lower surface contacts on the plug are engaged by contacts in the jack.

For various purposes, particularly for high speed data communications, it is necessary that modular jacks be shielded from electromagnetic interference (EMI). A number of shielding arrangements are suggested by the prior art, but a shield which allows for a low inductance path to ground and multiple contacts with a front equipment panel is still needed.

SUMMARY OF THE INVENTION

The modular jack of the present invention includes shielding which provides an affective scaled shielding of the modular jack and for a low inductance path to ground and multiple contacts with a front equipment panel. In one preferred embodiment, this assembly comprises an insulative housing comprising first and second longitudinal walls positioned such that said second longitudinal wall is superimposed over said first longitudinal wall in spaced parallel relation. At least one pair of lateral walls is interposed between the first and second longitudinal walls to form at least one transverse plug receiving cavity having a front opening. A metallic shield includes a first member and second member. The front member is superimposed over the second longitudinal wall of the housing. The second shield member surrounding the front opening of the transverse plug receiving cavity and is perpendicularly adjacent the front edge of the first shield member. A first connecting means which may be a clip with two resilient legs fastens the second shield member to the first shield member. The second shield member also has a tab which extends upwardly and rearwardly then downwardly and rearwardly to laterally abut the first member. A second tab extends rearwardly and upwardly adjacent said first tab. A panel positioned outwardly adjacent the upwardly extending section of the second tab flexes the first tab against the first member of the shielding. This arrangement is preferably repeated at spaced intervals along the front edge of the first shield member.

BRIEF DESCRIPTION OF THE DRAWINGS

The modular jack of the present invention is further described with reference to the accompanying drawings in which.

DETAILED DESCRIPTION OF THE PREFERRED EMBODIMENTS

Figure 1:
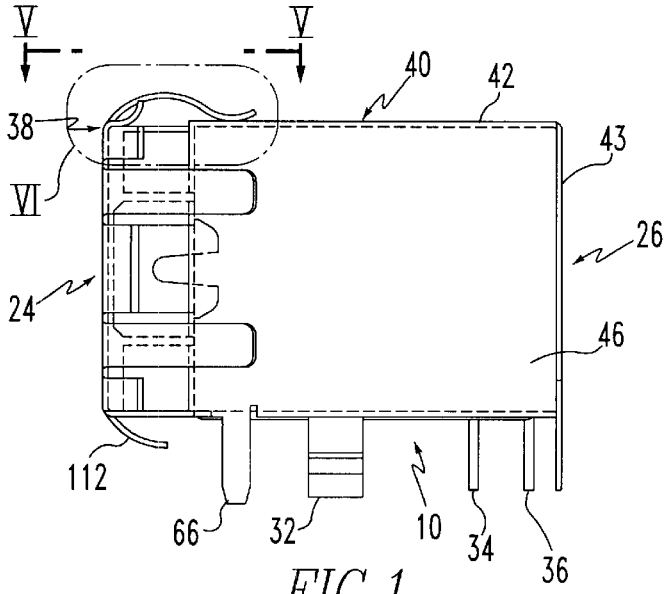
FIG. 1 is a side elevational view of the modular jack of the present invention.

Referring to FIGS. 1–4, the modular jack of the present invention includes an insulative housing shown generally at numeral 10. This housing includes a lower horizontal longitudinal wall 12 and an upper horizontal longitudinal wall 14. The housing also includes end lateral walls 16 and 18 as well as a plurality of intermediate lateral walls as at 20. Adjacent lateral walls as at 18 and 20 form plug receiving cavities as at 22. Each of these plug receiving cavities has a front open end 24 and a rear end 26. In each plug receiving cavity there is a medial wall 28 and steps as at 30 to form a key structure. The modular jack also includes mounting pins as at 32 and conductive terminals or contacts as at 34 and 36. The modular jack also includes a metallic shield shown generally at numeral 38. The metallic shield includes a first lateral member shown generally at 40 which has a horizontal wall 42 which is superimposed over upper horizontal wall 14 of the insulated housing. The first lateral portion 44 also includes a rear vertical wall 43 superimposed over rear end 26 and a lateral vertical wall 44 which is superimposed over lateral wall 16 of the insulated housing and lateral vertical wall 46 which is superimposed over lateral wall 18 of the insulated housing. The first lateral member of the shield has a front peripheral edge 48, and rearwardly spaced from this edge there is a peripheral step 50. At spaced peripheral intervals there are additional deeper recesses, 52, 54, 56, 58, 60 and 62. Each of those recesses has an engagement aperture as at aperture 64 in recess 60. The first lateral member of the shield also includes grounding pins such as pin 66. The shield also includes a second vertical member which is shown generally at numeral 70. This second vertical member of the shield is engaged to the first lateral member of the shield by a system clips which is explained as follows.

Figure 5:
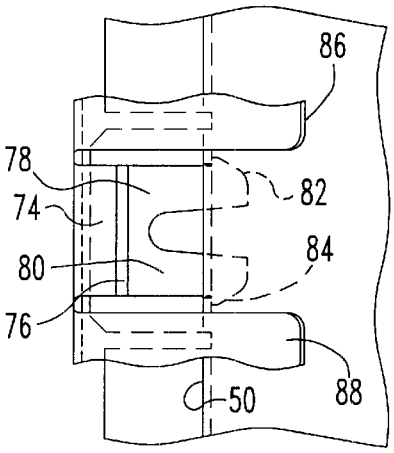
FIG. 5 is a detailed view from V—V in FIG. 1.
Figure 6:
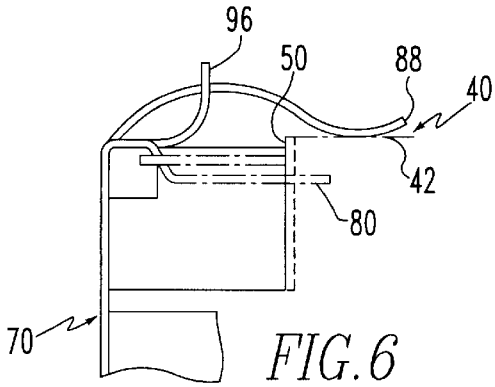
FIG. 6 is a detailed view of area VI in FIG. 1.
Figure 2:
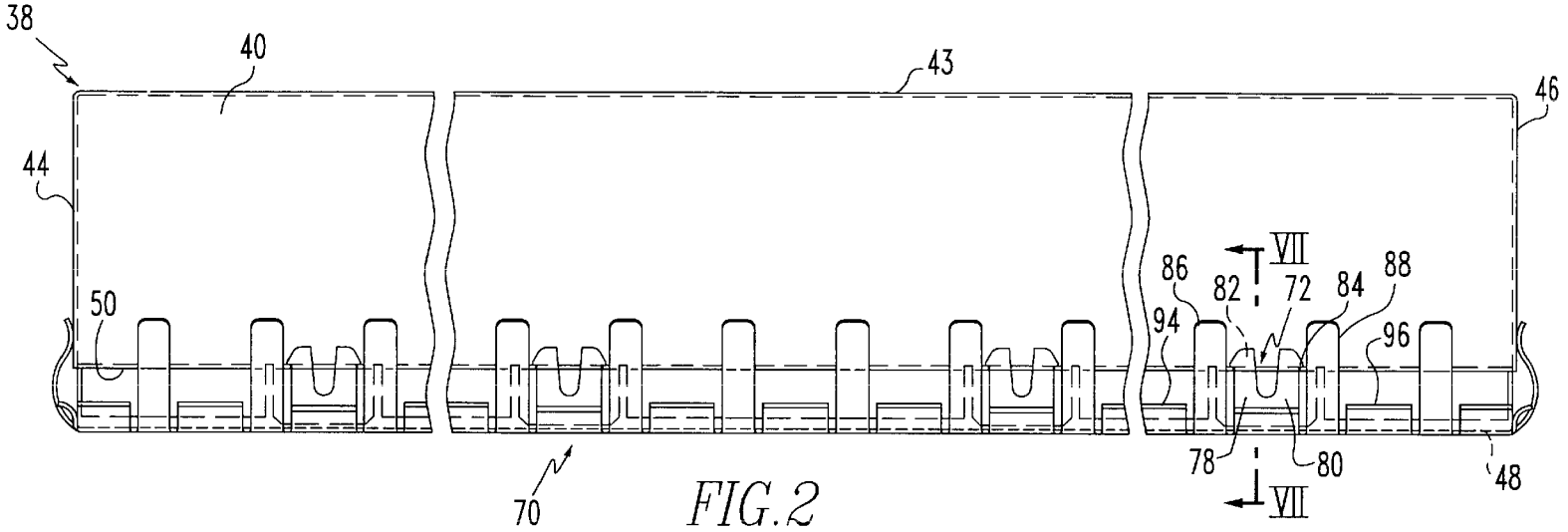
FIG. 2 is a fragmented top plan view of the modular jack shown in FIG. 1.
Figure 7:
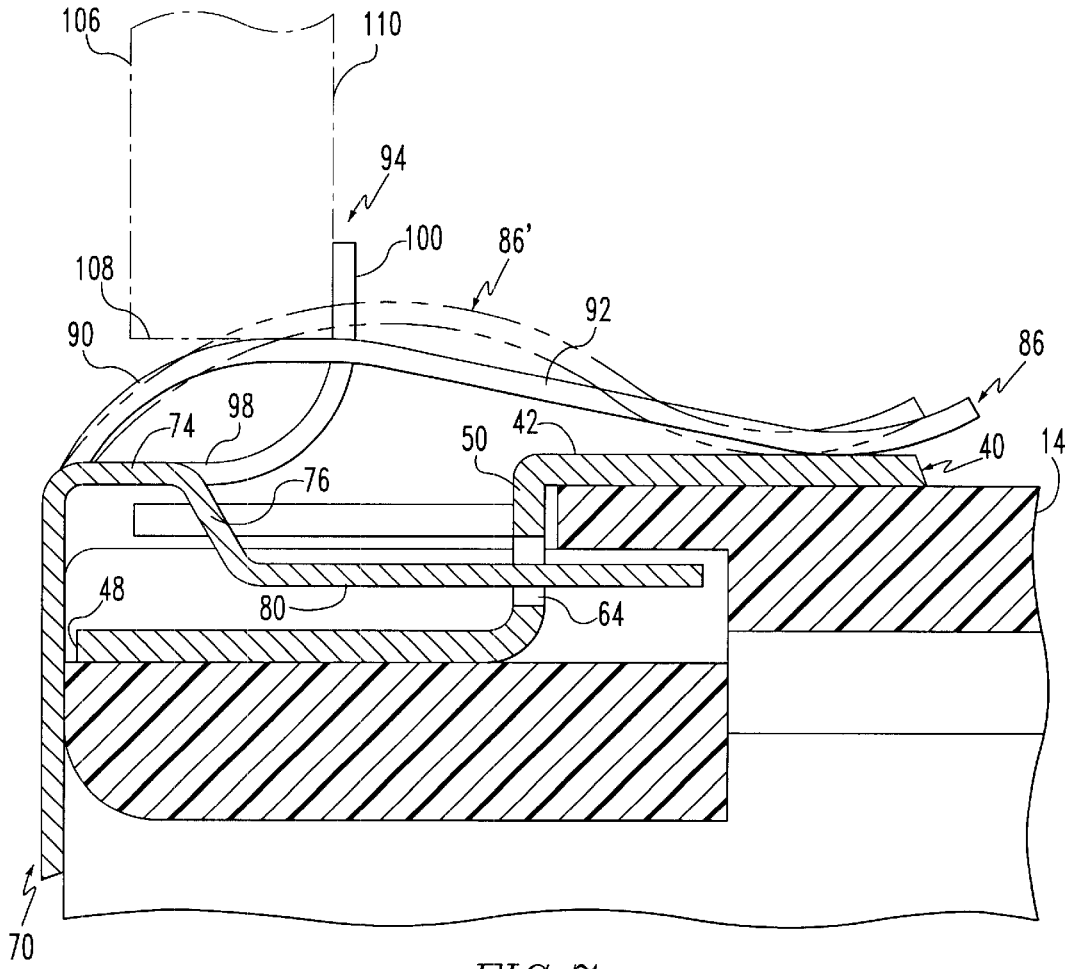
FIG. 7 is a schematic cross sectional view through VII—VII in FIG. 2 showing the operation of the shielding used in the modular jack of the present invention.

There are a number of first recess engaging clips shown generally at numeral 72. Referring to FIGS. 5–7, each of these recess engaging clips includes a rearward extension 74, a downward oblique section 76 and a pair of rearwardly extending legs 78 and 80 which have, respectively, rearward outwardly extending projections 82 and 84. These legs pass through recess apertures as at aperture 64 and the projections 82 and 84 grasp the edges of the apertures. Outwardly adjacent each of the recess engaging clips there are a pair of generally horizontal, cantilevered tabs as at 86 and 88.

Figure 3:
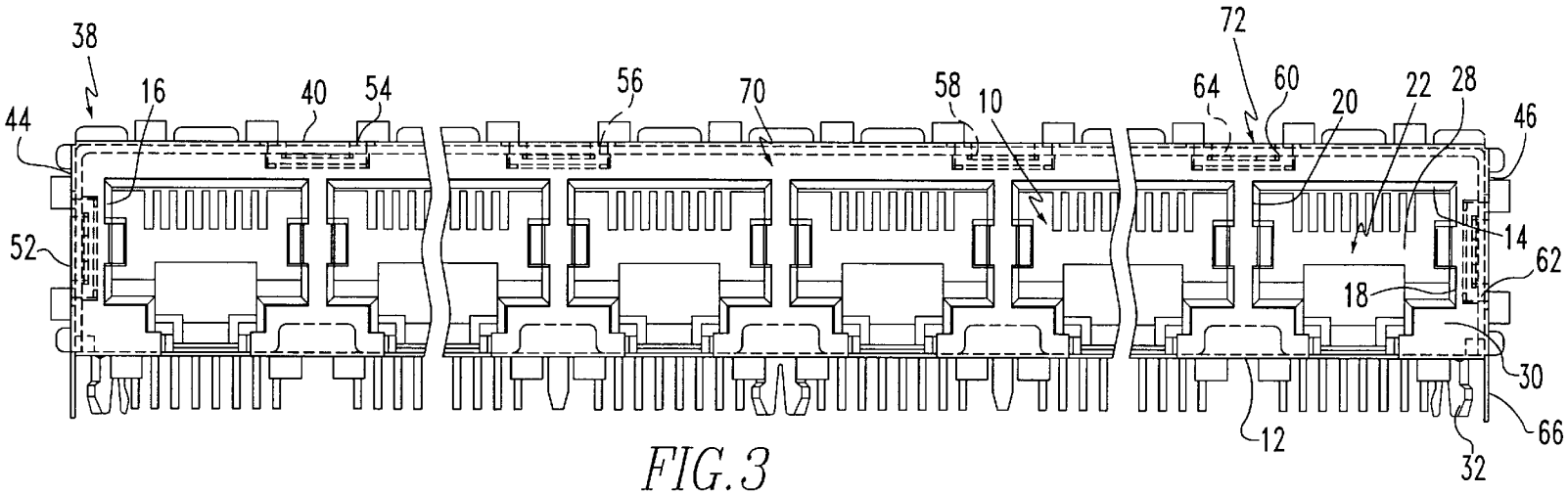
FIG. 3 is a fragmented front elevational view of the modular jack shown in FIG. 1.

Referring particularly to FIG. 7, it will be seen that a medial section of each of these tabs has an upwardly and rearwardly curved section 90 and then a downwardly and rearwardly curved section 92 which has a free distal end that abuts the first lateral section 40 of the shield. Outwardly adjacent the horizontal tabs as at 86 and 88 there is a pair of generally vertical tabs or lips as at 94 and 96. Each of these tabs has a rearwardly extending section 98 and an upwardly extending section 100. The three sets of tabs are used at spaced intervals along the peripheral edge 48 of the first member to effectively seal the modular jack from EMI. As seen in FIG. 3, the three sets of tabs are located along three sides of the connector (the top and the two side walls). The use of multiple tabs also serves to effectively ground the shield and the modular jack.

Figure 4:
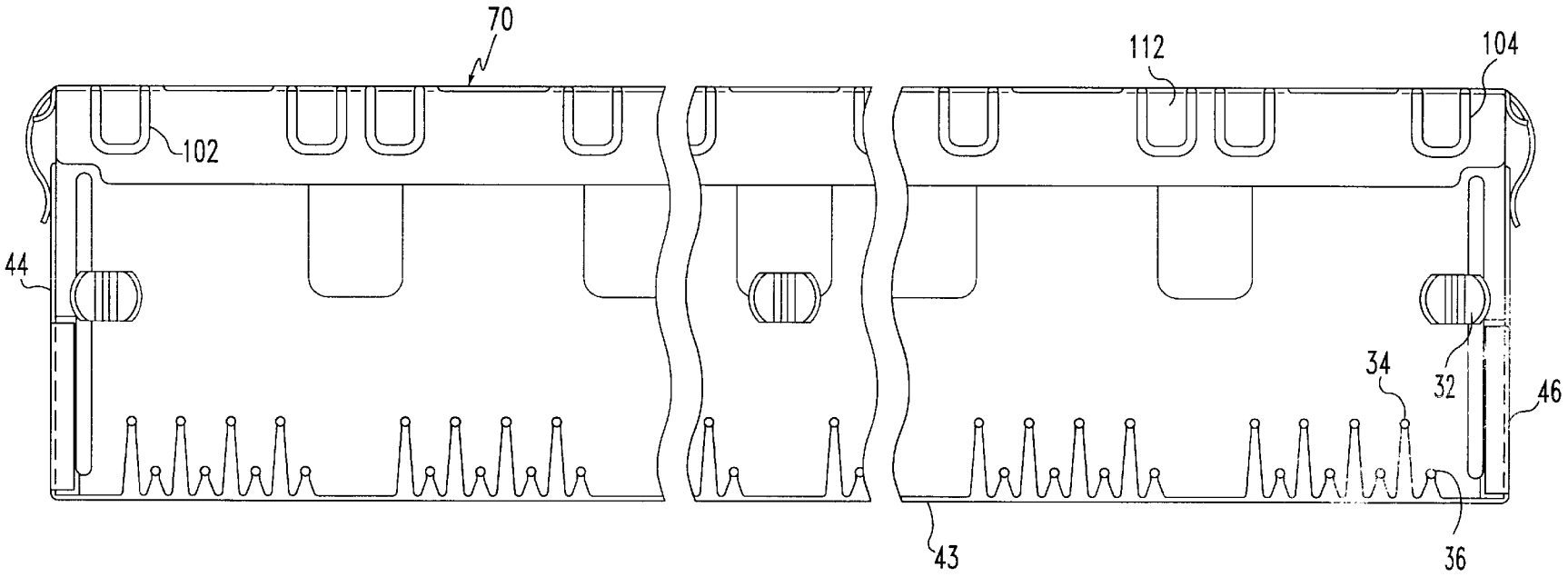
FIG. 4 is a fragmented bottom plan view of the modular jack shown in FIG. 1.

Referring particularly to FIG. 4, it will be seen that the front section 70 of the shield is also engaged to the lower longitudinal wall 12 by means of lower horizontal clips as at clips 102 and 104. Also, and as seen in FIGS. 1 and 4, cantilevered tabs 112 extend along the bottom wall of shield 70. Differently than tabs 86, the distal ends of tabs 112 do not engage shield 40.

Referring again particularly to FIG. 7, it will be seen the modular jack is engaged with a panel 106 that the second horizontal clips as at 86 will be flexed by the lower edge 108 of the panel from the relaxed position at 86. In other words, the distal end of tab 86 moves along shield 40 from the relaxed position (seen as a phantom line in FIG. 7) to the flexed position (seen as a solid line in FIG. 7) as the modular jack engages panel 106. It will also be seen that the generally vertical tabs as at 94 will engage the rear side 110 of the panel to firmly engage the panel and allow for effective shielding of the modular jack.

It will be appreciated that a means for effectively sealing a modular jack from EMI is provided. It will also be appreciated that a low inductance path to ground through multiple contacts is provided.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector assembly, comprising:

a housing;

a plurality of contacts in said housing; and a conductive shield generally surrounding said housing and having a cantilevered tab, said tab including opposed major surfaces, one of said major surfaces adapted to engage a panel into which the connector assembly inserts at a medial section of said tab and the other of said major surfaces in contact with said shield at a free distal end of said tab, said tab flexing when said medial section engages the panel.

2. The electrical connector assembly as recited in claim 1, wherein said shield further comprises a lip to engage the panel and to position the connector assembly within the panel.

3. The electrical connector assembly as recited in claim 1, wherein said distal end of said tab moves along said shield when said medial section engages the panel.

4. The electrical connector assembly as recited in claim 1, wherein said tab comprises a plurality of tabs located along three sides of said shield.

5. The electrical connector assembly as recited in claim 1, wherein said shield comprises a two-piece shield, with a first piece of said shield securable to said second piece of said shield, said tab located on said second piece.

6. The electrical connector as recited in claim 5, wherein said second piece further comprises a clip for retaining said second piece to said first piece.

7. The electrical connector assembly as recited in claim 1, wherein the connector assembly is a receptacle connector assembly.

8. The electrical connector assembly as recited in claim 7, wherein said receptacle connector assembly is a modular jack connector assembly.

9. An electronic component comprising:

a panel having an opening therein; and an electrical connector mounted in said opening, said electrical connector comprising:

a housing;

a plurality of contacts in said housing; and a conductive shield generally surrounding said housing and having a cantilevered tab with a medial section to engage said opening and a free distal end that is placed into contact with said shield, said tab flexing when said medial section engages the panel.

10. The electronic component as recited in claim 9, wherein said shield further comprises a lip to engage the panel and to position said connector within said panel.

11. The electronic component as recited in claim 9, wherein said distal end of said tab moves along said shield when said medial section engages said opening.

12. The electronic component as recited in claim 9, wherein said tab comprises a plurality of tabs located along three sides of said shield.

13. The electronic component as recited in claim 9, wherein said connector is a receptacle connector.

14. The electronic component as recited in claim 13, wherein said receptacle connector is a modular jack.

15. The electronic component as recited in claim 9, wherein said shield comprises a two-piece shield, a first piece of said shield generally located on a first side of said panel and a second piece of said shield generally located on a second side of said panel.

16. The electronic component as recited in claim 15, wherein said tab is located on said second piece and extends through said opening.

17. The electronic component as recited in claim 15, wherein said second piece further comprises a clip for retaining said second piece to said first piece.

18. The electronic component as recited in claim 15, wherein said second piece further comprises a lip to engage said first side of said panel and to position said connector within said opening.

19. The electronic component as recited in claim 15, wherein said connector enters said opening from said first side of said panel.

20. A conductive shield for an electrical connector mounted in a panel, comprising:

a body generally surrounding the electrical connector; and a cantilevered tab extending from said body, said tab having:

opposed major surfaces;

a medial section to engage the panel at one of said major surfaces; and a free distal end placed into contact with said body at the other of said major surfaces, said tab flexing when said medial section engages the panel.

21. The conductive shield as recited in claim 20, further comprising a lip extending from said body to engage the panel and to position the electrical connector within the panel.

22. The conductive shield as recited in claim 20, wherein said distal end of said tab moves along said body when said medial section engages the panel.

23. The conductive shield as recited in claim 20, wherein said tab comprises a plurality of tabs located along three sides of said shield.

24. The conductive shield as recited in claim 20, wherein the conductive shield is a two-piece shield, with a first piece of said shield securable to said second piece of said shield.

25. The conductive shield as recited in claim 24, wherein said tab is located on said second piece.

26. The conductive shield as recited in claim 24, wherein said second piece further comprises a clip for retaining said second piece to said first piece.

27. An electrical connector mountable to an opening in a panel, the connector comprising:

a housing;

a plurality of contacts in said housing; and a conductive shield generally surrounding said housing and having a plurality of cantilevered tabs located around an entire perimeter of the connector, each tab including:

a medial section to engage the opening; and a free distal end;

wherein at least some of said distal ends are placed into contact with said shield.

28. The electrical connector as recited in claim 27, wherein said distal ends that are placed into contact with said shield are located along three sides of the connector.

29. The electrical connector as recited in claim 27, wherein at least some of said distal ends are not placed into contact with said shield.

* * * * *